US006283819B1

(12) United States Patent
Polinger et al.

(10) Patent No.: US 6,283,819 B1
(45) Date of Patent: Sep. 4, 2001

(54) THEMATIC DOLL HOUSE

(76) Inventors: Kimmie Polinger; Jessica Polinger, both of 1370 Wilson Rd., Ashland, OR (US) 97520

( * ) Notice: Subject to any disclaimer, the term of this patent is extended or adjusted under 35 U.S.C. 154(b) by 0 days.

(21) Appl. No.: 09/488,768

(22) Filed: Jan. 21, 2000

(51) Int. Cl.[7] ..... A63H 3/52
(52) U.S. Cl. ..... 446/478
(58) Field of Search ..... 446/75, 82, 476, 446/478, 482

(56) References Cited

U.S. PATENT DOCUMENTS

| | | | | |
|---|---|---|---|---|
| D. 57,617 | | 4/1921 | Donahey | D21/507 |
| D. 194,428 | | 1/1963 | Ferriot | D34/15 |
| D. 277,202 | | 1/1985 | Appel et al. | D21/114 |
| D. 310,395 | | 9/1990 | Maloney, II | D21/114 |
| 2,040,974 | | 5/1936 | Bigelow | 446/477 |
| 3,182,420 | * | 5/1965 | Bender | 446/478 |
| 4,070,789 | * | 1/1978 | Levenson | 446/478 |
| 4,139,967 | | 2/1979 | Kuna et al. | 446/241 |
| 4,161,081 | * | 7/1979 | Katzman et al. | 446/476 X |
| 4,216,608 | | 8/1980 | Walmer et al. | 446/110 |
| 4,435,915 | | 3/1984 | Zaruba et al. | 446/75 |
| 4,781,643 | | 11/1988 | Holloway et al. | 446/75 |
| 4,883,443 | | 11/1989 | Chase | 446/478 |
| 4,988,321 | * | 1/1991 | Goldfarb | 446/75 |
| 5,120,262 | * | 6/1992 | Caine | 446/476 |
| 5,435,769 | | 7/1995 | Bertrand | 446/476 |
| 5,819,479 | | 10/1998 | Rodriguez-Ferre | 52/79.4 |

* cited by examiner

*Primary Examiner*—John A. Ricci
(74) *Attorney, Agent, or Firm*—Dellett and Walters; Howard Russell

(57) ABSTRACT

An improved doll house is provided for storing and playing with dolls and accessories that is configured so as to be thematically integrated with the dolls and accessories. The doll house comprises a plurality of molded, hollowed-out compartments which are hinged together to provide an openable enclosure with the appearance of a mushroom having a head section and a stem section. Concave berths, having bubble-shaped doors, are provided in the head section for storage of dolls which resemble faeries. Upper and lower scalloped seating areas are provided on an interior surface of the compartments to accommodate the dolls. The compartments include windows with curtains to allow one to view the interior of the doll house when the compartments are closed.

23 Claims, 3 Drawing Sheets

THEMATIC DOLL HOUSE

BACKGROUND OF THE INVENTION

This invention relates to toys, and more particularly to a toy doll house for housing, transporting and playing with figurines.

Toy playhouses for housing dolls and figurines, which provide space in which children can play with the dolls and figurines within the confines of the doll house are known. Various configurations have been selected for doll houses in the past, including hinged and multiple storied doll houses, having various levels of rooms, doorways, passageways, staircases, decks, etc. Some of these hinged doll houses have been collapsible with a handle thereon for transporting the doll house.

The themes or designs for doll houses have encompassed almost every imaginable overall appearance such as spaceships, vegetables, and medieval castles however, no doll house themes were integrally related to and implemented by storage and reposing structures for accommodating likewise thematic figurines in a manner in accordance with and befitting the overall theme of the doll house.

SUMMARY OF THE INVENTION

In accordance with the present invention, an improved thematic doll house is provided for storing and playing with thematically integrated dolls and doll accessories.

Accordingly, it is an object of the present invention to provide an improved doll house that constitutes a pair of mating, mushroom-shaped compartments which are hinged together to form a free standing compartmentalized enclosure, that when opened allows access to the interior surfaces of the compartments.

It is a further object of the present invention to provide an improved doll house in the shape of a mushroom with concave enclosed areas, molded into the head of the mushroom so as to house dolls that are visible and accessible through openable transparent bubble-like doors.

It is another object of the present invention to provide an improved mushroom-shaped doll house with internal drawers to allow storage of doll related accessories.

It is still a further object of the present invention to provide an improved mushroom-shaped doll house formed from two interior hollowed-out shell halves each having a scalloped seating arrangement formed in semi-circular fashion around the bottom of the mushroom head shaped section of the doll house such that a circular, scalloped seating arrangement for dolls is formed when the doll house halves are closed.

It is yet another object of the present invention to provide an improved mushroom-shaped doll house formed from two interior hollowed-out shell halves each having a scalloped seating arrangement formed in semi-circular fashion around the base of the mushroom stem shaped section of the doll house such that a circular, scalloped seating arrangement for dolls is formed when the doll house halves are closed.

An intention of the present invention is to provide an improved mushroom-shaped doll house with drawstring-type curtains employed to cover sections of the doll house compartments when the doll house is an open position.

A further intention of the present invention is to provide an improved mushroom-shaped doll house with mystical looking clear plastic windows molded in the stem section of the mushroom-shaped doll house, to allow peering into the doll house when the doll house is in a closed position, or from the backside of the doll house when the doll house is in an open position.

In accordance with still another aspect of the invention, a removable table is provided that is capable of being affixed to the base of one of the halves of the mushroom-shaped playhouse in a location central to a lower scalloped seating area.

Accordingly, it is another object of the invention to provide a thematic mushroom-shaped doll house for storing and allowing the reposing of dolls in a manner consistent with the theme of the housing structure including providing novel "sleeping arrangements" for Faerie-type dolls about the periphery and surface of the head of the mushroom-type doll house.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

DETAILED DESCRIPTION

The doll house according to the present invention comprises a free standing thematic enclosure formed in two mating sections from hollowed out compartments hinged together that, when closed, have the external appearance of a mushroom. The interior design incorporates seating and storage areas which are accessible through select openable translucent convex bubble-shaped doors on the exterior surface of the head section of the mushroom when closed. The interior is also accessible when the compartments are opened. Dewdrop-shaped concave storage enclosures are molded into the exterior surface of the head for the storage of dolls. The interior layout of the doll house incorporates seating areas, tables and storage drawers as well as removable curtains to conceal sections of the compartments. The doll house is thematically designed for the storage, presentation and manipulation of dolls sharing the same theme orientation, i.e., such as Faeries or the like.

Figure 1:
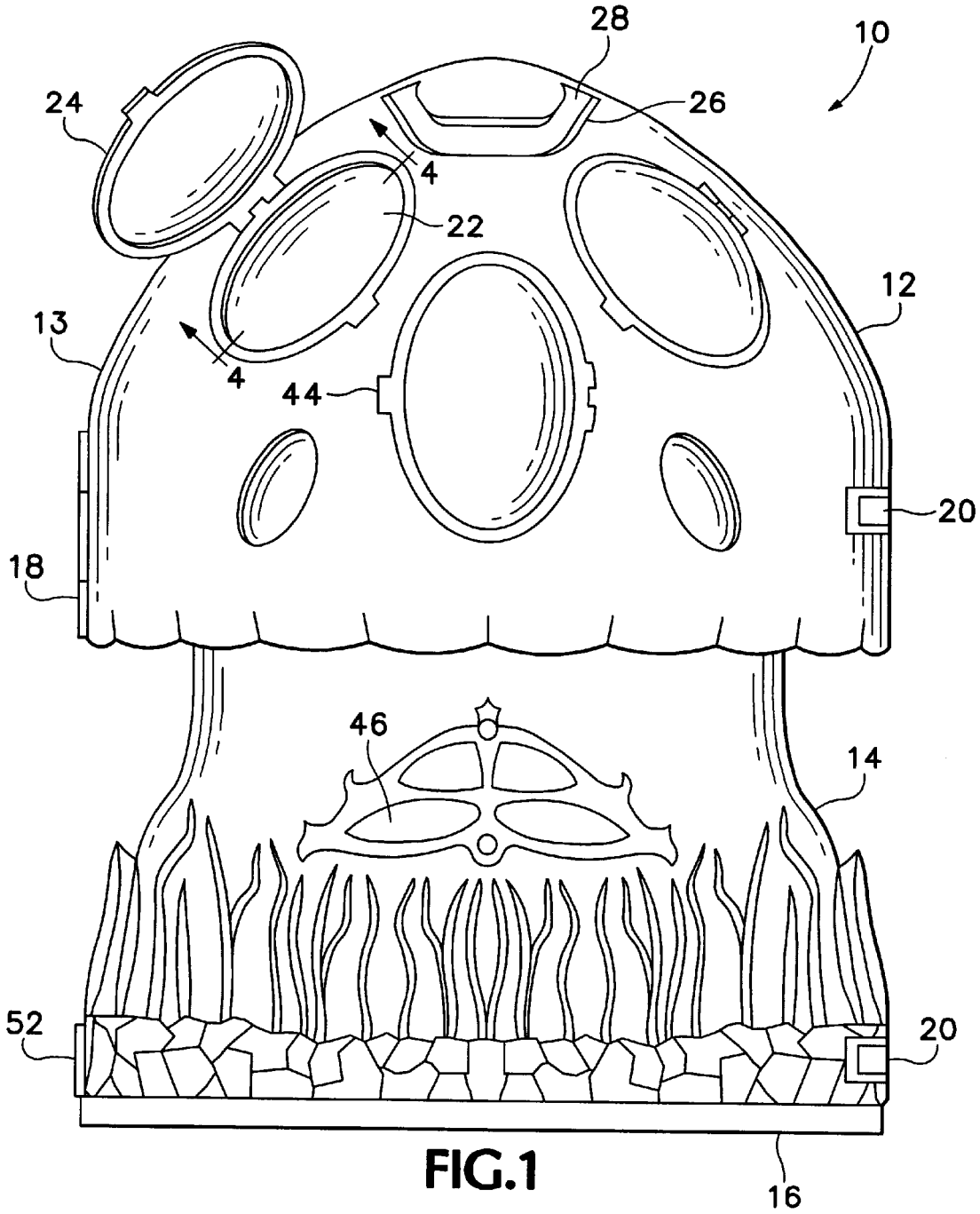
FIG. 1 is a side perspective view of a thematic doll house in a closed configuration according to the preferred embodiment of the present invention.

Referring to FIG. 1, a side perspective view of a thematic doll house in a closed configuration, it can be seen that the doll house 10 is architecturally configured with a head section 12, a stem section 14 and a base 16 so that the external surface 13 resembles a mushroom. There are two mating portions in the illustrated embodiment. Each mating portion has an upper complementary hinge 18 and a lower complementary hinge 52 on one side and a latching mechanism 20 located on an opposite side. Plural openable doors 24 are molded in spaced arrangement into head section 12 and are suitably shaped and translucent so as to allow viewing of concave storage compartments 22. Translucent skylight doors 44 are provided on the face of the head section and open to allow direct access into the interior of head section 12. Mystic-shaped windows 46 are placed in the stem region (one such window on each of the two mating sections) and enable viewing the interior of stem section 14. A handle recess 26 is molded into doll house 10 at the apex of head section 12 to accept a handle portion 28. Suitably two such handle portions are provided that function together to comprise a carrying handle when the doll house is in a closed position.

Figure 2:
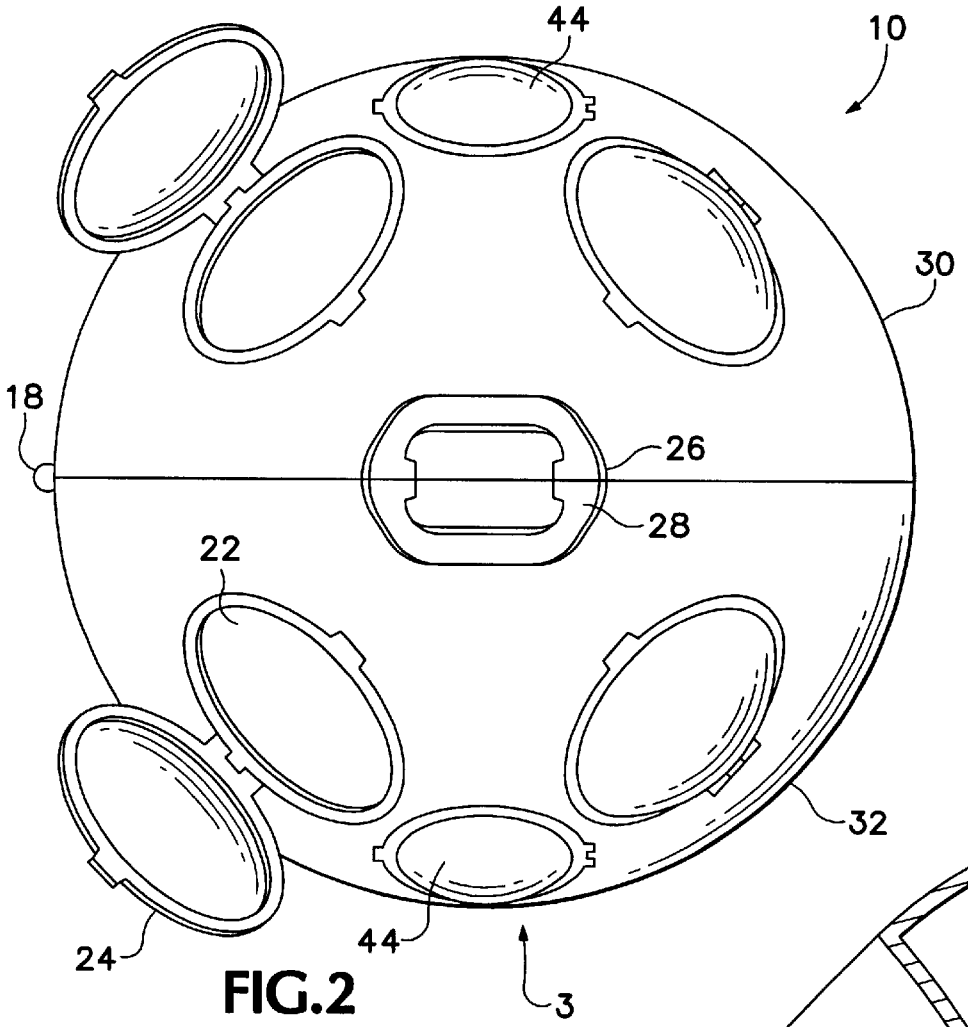
FIG. 2 is a top view of a thematic doll house in a closed configuration according to the preferred embodiment of the present invention.

Referring to FIG. 2, a top view of the thematic doll house in a closed configuration, it can be seen that the first mating portion 30 and the second mating portion 32 are substantially similar halves of the assembled doll house 10. The two halves may comprise, for example, mirror images.

Figure 3:
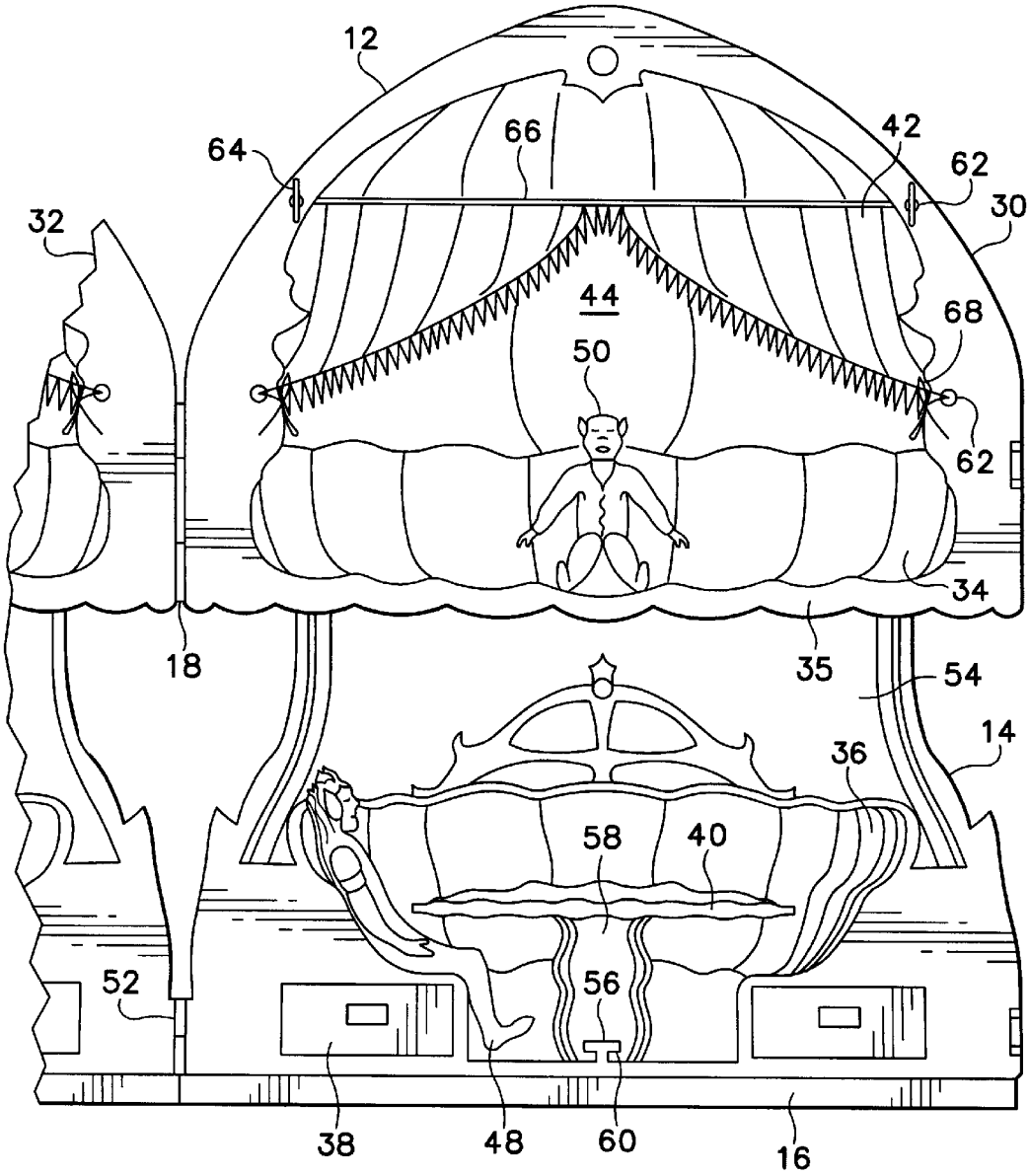
FIG. 3 is a partial side perspective of the thematic doll house of FIG. 1 in an open configuration according to the present invention viewed in the direction indicated by arrow 3 of FIG. 2.

Referring to FIG. 3, a partial side perspective of the thematic doll house of FIG. 1 in an open configuration according to the present invention, the view being taken in the direction indicated by arrow 3 of FIG. 2, it can be seen that first mating portion 30 and second mating portion 32 are hollowed out compartments with a first upper semicircular seating arrangement 34 situated on the internal surface of the head section 12 and a second lower semicircular seating arrangement 36 positioned on the internal surface of the stem section 14. Dolls 48 and 50 are suitably configured like Faeries and movably reside within the confines of mating portion 30. Drawers 38 are molded under second seating arrangement 36 (two such drawers being provided in each portion 30, 32 in the preferred embodiment) and a table 40 is slideably affixed to base 16 by tab 56 which is substantially centered with respect to semicircular seating arrangement 36. Adjustable curtains 42 traverse the width of mating portion 30. The openable translucent skylight 44 is visible from mushroom head section 12 and mystic windows 46 are visible from within mushroom stem section 14, there being a floor portion 35 that partitions the interior of head section 12 from the interior of stem section 14 when the doll house is in a closed configuration.

Figure 4:
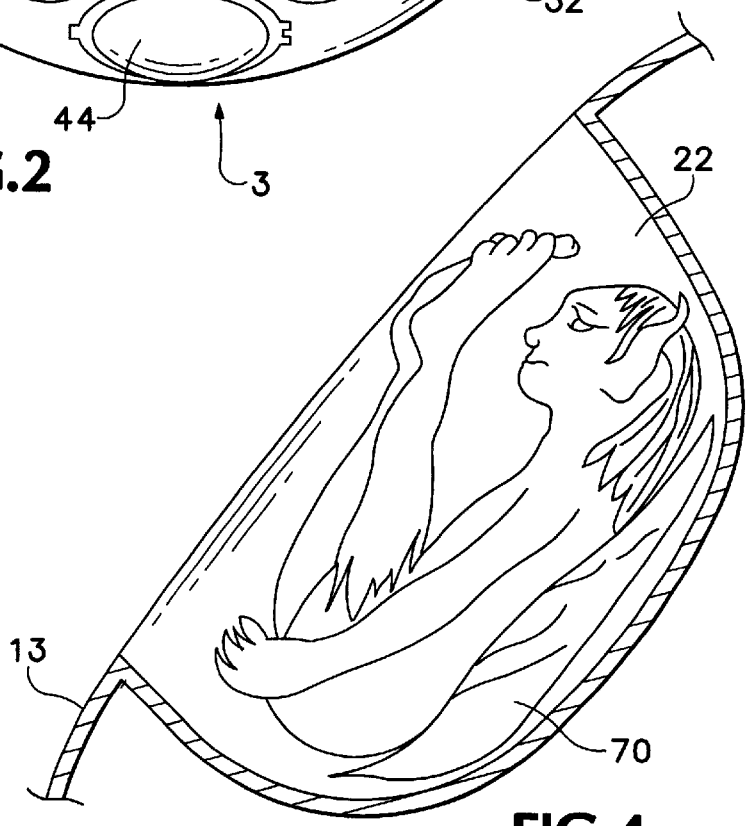
FIG. 4 is an enlarged partial cross sectional view of a dewdrop-shaped storage compartment with a convex bubble-shaped door as taken substantially along the line 4—4 of FIG. 1.

FIG. 4, an enlarged partial cross sectional view of a dewdrop-shaped storage compartment as taken substantially along the line 4—4 of FIG. 1, shows a Faerie doll 70 in a "resting" or storage position in a concave storage compartment 22.

Referring to FIGS. 1–3 together, it can be seen that first mating portion 30 and second mating portion 32 are substantially mirror image configurations of each other attached by upper hinge 18 and lower hinge 52. Each portion has an interior surface 54 that is a compartmentalized or hollowed out cavity and an exterior surface 13 preferably configured in the appearance of a mushroom. As noted above, numerous translucent convex bubble-shaped doors 24 adorn the exterior surface of head section 12 of the mushroom doll house and enclose concave storage compartments 22. These bubble-shaped doors resemble dew drops on the head of the mushroom in which dolls such as Faerie dolls 70 can "sleep", or otherwise reside. The doll house is constructed of a suitably moldable and resilient material such as rubber or a plastic polymer.

Upper hinge 18 and lower hinge 52 have their longitudinal axes vertically aligned so that when first portion 30 and second portion 32 are pivoted about this common longitudinal hinge axis to an "open" position, interior surfaces 54 are exposed for presentation and play. When first portion 30 and second portion 32 are pivoted about the hinges to a "closed" or "mated" position, locking latch 20 is engaged, the exterior surfaces 54 form a mushroom configuration and the interior surfaces are accessible only through openable translucent skylight doors 44. In this closed position interior surfaces 54 also remain viewable through translucent mystic-shaped windows 46. Whether in the open or closed position, the doll house is a free standing structure resting upon the base 16 of both sections.

As noted above, the interior surfaces 54 are compartmentally divided into two circular scallop-shaped seating arrangements. First seating arrangement 34 is located in head section 12 and second seating arrangement 36 is located in stem section 14. Both seating arrangements allow for the repose of play figurines such as Faerie dolls 48 and 50. Second seating arrangement 36 has removable table accessory 40 which can be centrally positioned in relation to the circular configuration of the seating arrangement by the engagement of a T-shaped tab 56 affixed to base 16 into a mating slot 60 in table base 58.

Operable drawers 38 are located between base 16 and second seating arrangement 36 for the storage of accessories such as eating paraphernalia, curtains, pillows and other play accessories. Such formed drawers may be located both proximally and distally from the hinged sides of the doll house, and in one or a variety of locations in each of the head or stem sections.

Operable curtains 42 may be extended across the cavity of the internal surfaces of either first mating portion 30 or second mating portion 32. Orifices 62 are located at different positions vertically on either side of the mating portions so as to receive metal tabs 64 which are on the distal ends of curtain drawstring 66. The tabs extend normally from the drawstring such that once inserted into the orifices, will hold the curtain in place. Drawstrings 68, also utilizing orifices 62, may be provided for adjustment of the curtain.

Handle recesses 26 are molded into the apex of head sections 12 to pivotally receive complimentary profiled handles 28. When the doll house is in the closed position handles 28 may be pivoted from their recesses to matingly contact each other to form a transporting handle.

When playing with doll house 10, it may be opened or closed. When the doll house is closed the dolls may be accessed in concave storage compartments 22 by opening bubble doors 24. The dolls inside the doll house may also be accessed and viewed through skylight 44 or may be viewed through mystic windows 46. When the doll house is open, dolls may be positioned at various places around seating arrangements 34 and 36, table 40 may be affixed to base 16, the accessories may be accessed from openable drawers 38 and curtains 42 may be manipulated.

Accordingly a thematic doll house is provided for presentation and play with Faeries, wherein the integration of elements such as a mushroom configuration, mystic-shaped windows, dew drop skylights and concave sleeping compartments establish and maintain the Faerie theme.

While a preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

What is claimed is:

1. A doll house comprising;

a plurality of molded, hollowed-out, compartments which altogether define an openable enclosure with an external appearance of a mushroom and having a head section and a stem section, wherein each said compartment has an interior surface, an exterior surface and a base and is connectively hinged to adjacent compartments and has a locking apparatus, such that said plurality of compartments may be pivoted about a hinge axis to form a free-standing presentation doll house allowing access to said interior surfaces; and a plurality of concave berths distributed about the exterior surface of a head section of at least one said hollowed-out compartment, said berths having openable, translucent, convex, bubble-shaped doors.

2. The doll house of claim 1, further comprising at least one openable drawer residing in at least one molded recess within at least one of said hollowed-out compartments, wherein said drawer is adapted for holding implements for playing.

3. The doll house of claim 2, further comprising a plurality of first scalloped seating areas positioned in partial circular fashion on an interior surface of said compartments at a bottom of said head section such that when said doll house is in a closed position said plurality of compartments mate and form a horizontally positioned circular scalloped first seating area wherein dolls may be positioned.

4. The doll house of claim 3, further comprising a plurality of second scalloped seating areas positioned in partial circular fashion on an interior surface of said compartment at said bases of the stem sections such that when said doll house is in a closed position the plurality of compartments mate to form a horizontally positioned circular scalloped second seating area wherein dolls may be positioned.

5. A doll house in accordance with claim 4 further comprising at least one drawstring curtain attached to said head section of at least one of said compartments at a location above said first seating area such that said curtain may shelter a portion of said interior surface of said hollowed-out compartment.

6. A doll house in accordance with claim 4 further comprising at least one skylight located in said head section of at least one compartment, said skylight allowing access to said interior surface of at least one said hollowed-out compartment.

7. A doll house in accordance with claim 6 wherein said skylight is openable.

8. The doll house of claim 1 further comprising at least one seating area molded into at least one interior surface of said hollowed-out, compartments.

9. A doll house in accordance with claim 1, further comprising a table removably anchored to at least one of said bases in at least one of said hollowed-out compartments.

10. The doll house of claim 9, wherein the number of plural compartments is two.

11. The doll house of claim 10 further comprising at least one openable drawer residing in at least one molded recess within at least one of said hollowed-out compartments wherein said recesses are located adjacent said first scalloped seating area.

12. A doll house in accordance with claim 1 further comprising;

at least one handle; and at least one handle recess with a profile that corresponds to said handle and is located in said exterior surface of said head section of at least one hollowed-out compartment, wherein said handle pivotally resides within said handle recess.

13. A doll house in accordance with claim 1 further comprising windows located in the said stem section of at least one said compartment.

14. A mushroom-shaped doll house comprising:

a pair of mating compartments having exterior surfaces and interior surfaces, an exterior surface of each said compartment being molded in the shape of a mushroom having a head section, a stem section and a base, and said compartments being hingedly connected to one another at a first side and having a locking latch at a second side, wherein said compartments are moveable to an open position allowing access to an interior portion of each compartment and closeable to form a mushroom-shaped enclosure and wherein said head section and stem section are separated by a floor substantially parallel to said base;

a plurality of concave enclosures molded into said exterior surface of said head section wherein each said enclosure has an openable door of a convex-shaped translucent material; and at least one partial circular scalloped seating area molded within the interior portion of at least one compartment.

15. The doll house of claim 14 wherein said at least one partial circular scalloped seating area comprises a first partial circular scalloped seating area molded into said floor and at least one partial circular scalloped seating area comprises a second semi-circular scalloped seating area molded into said base.

16. The doll house of claim 15 further comprising:

a table with a pedestal having a recess defined therein; and a cleat affixed to said base wherein said cleat has a profile corresponding to said recess, wherein said cleat slidingly engages said recess in said pedestal so as to removably anchor said table to said base.

17. The doll house of claim 16 wherein said recess and said corresponding profile of said cleat are T-shaped.

18. The doll house of claim 17 further comprising a plurality of drawers residing adjacent the second seating area, said drawers being adapted for holding play implements.

19. The doll house of claim 14 further comprising a removable, operable curtain extending between the first side and second side of at least one compartment.

20. A doll house in accordance with claim 14 further comprising:

at least one handle; and at least one handle recess with a profile that corresponds to said handle and is located in said exterior surface of said head section of at least one mating compartment, wherein said handle pivotally resides within said handle recess.

21. The doll house of claim 14 further comprising an openable skylight located in said head section for allowing access to said interior surface of at least one head section.

22. The doll house of claim 14 further comprising at least one window located in an exterior surface of at least one of said stem sections.

23. A mushroom shaped doll house comprising:

a pair of mating compartments having exterior surfaces and interior surfaces, an exterior surface of each said compartment being molded in the shape of a mushroom having a head section, a stem section and a base, and said compartments being hingedly connected to one another at a first side and having a locking latch at a second side, wherein said compartments are moveable to an open position allowing access to an interior portion of each compartment and closeable to form a mushroom-shaped enclosure;

a floor substantially parallel to said base that separates said head section and stem section;

a plurality of concave berths molded into said exterior surface of said head section wherein each said berth has an openable convex-shaped door made of a translucent material and is adapted for the repose of thematic dolls;

an openable skylight located in said head section for allowing access to a portion of said interior surface of at least one compartment;

at least one window located in an exterior surface of at least one of said stem sections;

a removable, operable curtain extending between the first side and second side of at least one compartment;

a table with a pedestal having a recess therein;

a cleat affixed to said base wherein said cleat has a profile corresponding to said recess and slidingly engages said recess so as to removably anchor said table to said base;

a first partial circular scalloped seating area molded into said floor within the interior portion of at least one compartment;

a second partial circular scalloped seating area molded into said base within the interior portion of at least one compartment;

at least one handle adapted for transporting said doll house; and at least one handle recess with a profile that corresponds to said handle and is located in said exterior surface of said head section of at least one mating compartment, wherein said handle pivotally resides within said handle recess.

* * * * *

UNITED STATES PATENT AND TRADEMARK OFFICE
Certificate

Patent No. 6,283,819 B1

Patented: September 4, 2001

On petition requesting issuance of a certificate for correction of inventorship pursuant to 35 U.S.C. 256, it has been found that the above identified patent, through error and without deceptive intent, improperly sets forth the inventorship.

Accordingly, it is hereby certified that the correct inventorship of this patent is: Kimmie Polinger, Ashland, Oregon.

Signed and Sealed this Twenty-fifth Day of June 2002.

DERRIS H. BANKS
*Supervisory Patent Examiner*
Art Unit 3712